United States Patent [19]

Lee et al.

[11] 4,232,308

[45] Nov. 4, 1980

[54] WIRELESS ALARM SYSTEM

[75] Inventors: Maw H. Lee, Broadview Heights; John E. Keim, Lodi, both of Ohio

[73] Assignee: The Scott & Fetzer Company, Cleveland, Ohio

[21] Appl. No.: 50,802

[22] Filed: Jun. 21, 1979

[51] Int. Cl.[3] ..... G08B 1/00

[52] U.S. Cl. ..... 340/539; 340/636

[58] Field of Search ..... 340/147 R, 167 R, 168 R, 340/539, 636, 500; 343/225, 226

[56] References Cited

U.S. PATENT DOCUMENTS

| | | | |
|---|---|---|---|
| 4,056,815 | 11/1977 | Anderson | 340/636 |
| 4,141,010 | 2/1979 | Umpleby et al. | 343/225 |

*Primary Examiner*—Alvin H. Waring

*Attorney, Agent, or Firm*—Pearne, Gordon, Sessions

[57] ABSTRACT

A radio receiver equipped central control unit continuously monitors at least one battery-powered remote transmitter activated in response to predetermined alarm conditions, such as open doors and windows, fire, smoke, low transmitter battery voltage, and the like. In its activated condition, the transmitter is cycled to radiate a one-second duration radio frequency signal every 30 seconds, such cycling being established by transmitter timer circuitry series-inserted between the transmitter and its battery power source. The transmitted signal is received by the central control unit which, in response to the received signal, selects and activates one or more alarm indicators for a predetermined time period. Such selection and activation of particular alarm indicators and the duration of their activation are determined by switching and timing circuitry series-inserted between the central control unit's radio frequency receiver and the various alarm indicators.

10 Claims, 4 Drawing Figures

WIRELESS ALARM SYSTEM

BACKGROUND OF THE INVENTION

The present invention relates in general to alarm condition detector and indicator systems, and more particularly to a low cost, wireless alarm system suitable for home use.

Appreciating property values and a rise in the incidence of home burglaries have increased the need for a reliable, low cost alarm system to alert the homeowner to potentially dangerous conditions such as unauthorized entries, fire, smoke, and the like. It is desirable to provide such an alarm system in a form that will permit ready installation by the homeowner in a simple and straightforward manner without the need for hard wiring. It is further desirable to provide such a system with means for maintaining its operation in the event of commercial power loss.

While attempts have been made to design radio frequency transmitter/receiver alarm systems which meet the above-noted criteria, such attempts, to the knowledge of the present inventor, have not met with success.

SUMMARY OF THE INVENTION

A wireless alarm system in accordance with the present invention includes one or more battery-powered radio frequency transmitters located at door/window sites, smoke and fire detection sites, and the like. Switching means response to detection of an alarm condition at the general site of the transmitter causes such transmitter to radiate an intermittent radio frequency signal at a regular interval. Timing circuitry provides the radiation interval, preferably one second of signal radiation every 30 seconds. A radio receiver-equipped central control unit, in response to the receipt of the radiated signal, energizes one or more selected alarm indicators, the selection of alarm indicators and the duration of their energization being determined by switching and timing circuitry included in the central control unit. Preferably, a low battery detection circuit is included within each transmitter. The low battery detection circuit, upon sensing a low battery condition, triggers the transmitter to radiate a low battery detect signal (distinguishable from the radiated signal provided by the transmitter in its normal mode operation). The central control unit receives the radiated signal indicative of a low battery condition at a transmitter site and activates an appropriate low battery alarm indicator.

DETAILED DESCRIPTION OF THE PREFERRED EMBODIMENT

Figures 1, 2:
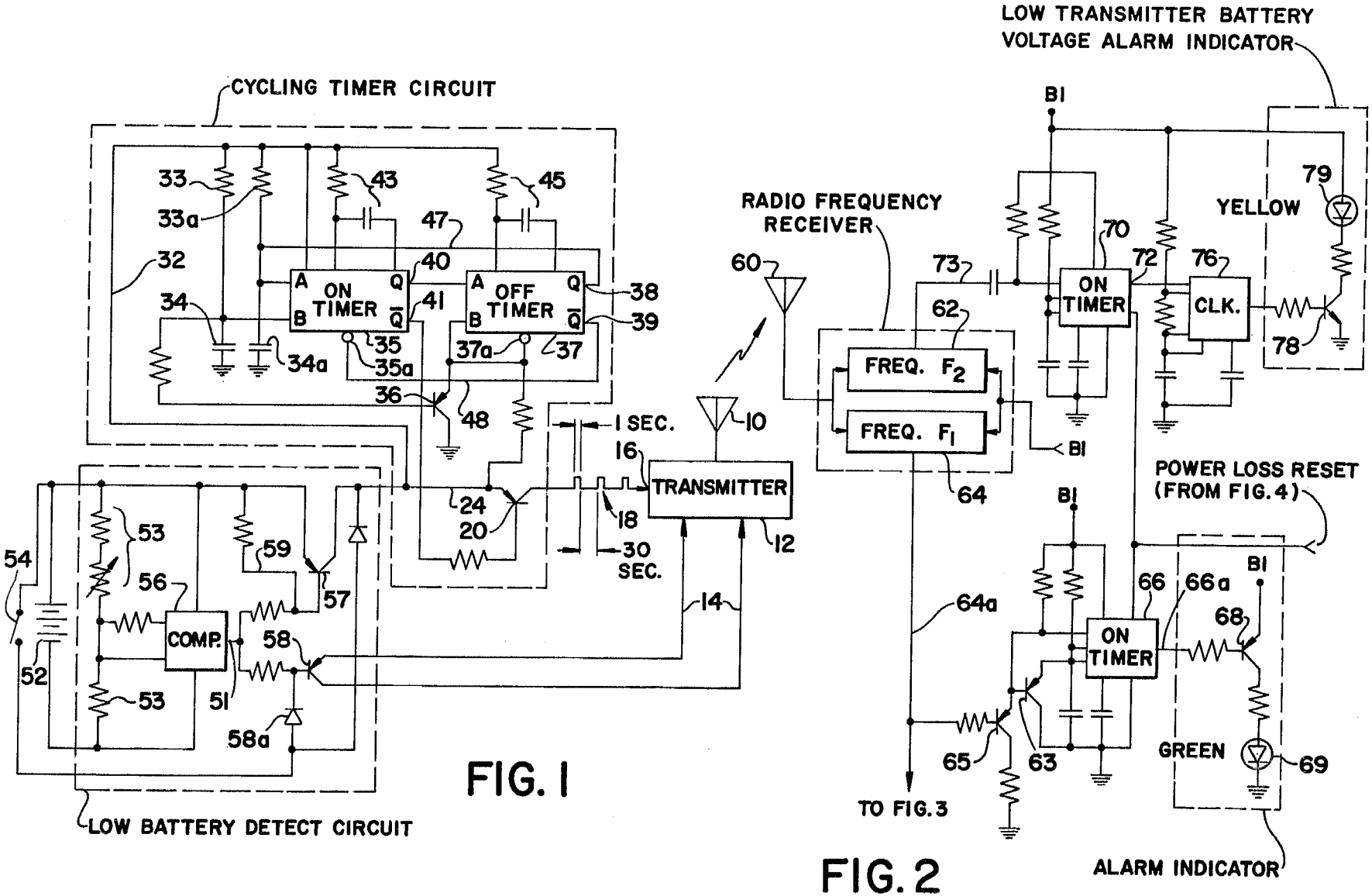
FIG. 1 illustrates, in schematic form, a radio frequency transmitter means in accordance with the present invention, the illustrated transmitter means including a low battery voltage detection circuit.
FIG. 2 schematically illustrates a portion of a radio receiver-equipped central control unit in accordance with the present invention.

In accordance with the present invention, FIG. 1 schematically illustrates an alarm sensing radio frequency transmitter means which includes a signal radiating antenna 10 driven by the output of a conventional radio frequency transmitter 12 for providing at least two radio frequency signals having signal patterns distinguishable from each other, the transmitter 12 being switchable between the two signal patterns by means of electrically shorting or opening a pair of signal pattern switching lines 14. Numerous methods for coding two separate transmitter signals so as to be able to distinguish them from each other can be utilized, for example, different carrier frequencies can be used, a common carrier frequency can be used with different modulation signals imposed thereon, or the transmitted signals can be digitally coded. A suitable digital coding radio frequency signal transmitter for use in the present invention is manufactured by the Multi-Elmac Company of Novi, MI and carries Model Number 1089 . Such a transmitter provides for 1024 separate digital codes set by a series of 10 on-off switches which provide the necessary code capability. The provision of numerous codes advantageously lessens the chance of false triggering of the alarm system of the present invention by stray noise or other alarm system radio frequency transmitters of the same type located nearby. U.S. Pat. No. 4,140,010, herein incorporated in its entirety by reference, illustrates a transmitter of digital coding type.

The transmitter 12, with the signal pattern switching lines 14 in an open or non-shorted condition, will, upon the application of power to the transmitter 12 radiate or broadcast a first radio frequency signal carrying, for example, a predetermined digital pattern. Upon shorting of the signal pattern switching line, the transmitter will radiate a second radio frequency signal carrying a different digital code distinguishable from that carried by the first radio frequency signal. Thus, it can be seen that the transmitter 12 is capable of radiating either of two signals distinguishable from each other, the signal radiated being dependent upon a shorted or open condition of the signal pattern switching lines 14. Activation of the transmitter 12 is provided by applying appropriate power, for example +9 VDC, to its transmitter power input 16. Continuous application of power to the transmitter power input 16 will cause corresponding continuous radiation of a radio frequency signal of the first or second pattern depending on the shorted or non-shorted condition of the pair of signal pattern switching lines 14. In accordance with the present invention, the power applied to transmitter power input 16 is cycled between a full power and no power condition to provide a regular cycle of on and off times for the transmitter 12. Preferably, the transmitter is turned on for one second and off for approximately 30 seconds during detection of an alarm condition at the transmitter site. A transmitter power wave form 18, schematically superimposed on the transmitter power input 16, illustrates the cycle timing of the transmitter 12.

Application of power to the transmitter 12 is provided via a transmitter power applying transistor switch 20 series-inserted between the transmitter power input 16 and a +9 VDC power buss 24, the transistor switch 20 being part of a cycle timer circuit as illustrated in FIG. 1. Cycling on and off of the transmitter power applying transistor switch 20 is provided by the cycling timer circuit, which intermittently drives the base of the transistor switch 20. The cycling timer circuit includes an ON timer 35 and an OFF timer 37, which for example can be constituted by respective halves of a CMOS type National MM74C221 integrated circuit timer or an equivalent thereof. The time durations of the timers 35,37 are determined by appropriate resistor-capacitor networks 43,45, which, in the case of the illustrated embodiment, provide a one-second time duration for the ON timer 35 and a 30 second time duration for the OFF timer 37. The timers 35,37 are of conventional configuration, each having respective A and B trigger inputs and respective reciprocal Q and Q-bar outputs. Power to the cycling timer circuit is provided via a timer circuitry power line 32 connected to the +9 VDC power buss 24. The A inputs of the timers 3537 are triggered only by negative going signals, while the B inputs of the timers 35,37 are triggered only by positive going signals. Such timer triggering configurations are well known in the art.

In accordance with the invention, upon application of power to the +9 VDC power buss 24, current will initially conduct via the timer circuitry power line 32, through start-up resistors 33, **33*a* and start-up capacitors 34, 34*a*. The respective resistors and capacitors are parallel with each other, as illustrated and connected between the power line 32 and electrical ground. Upon initial application of power, the voltage at the B input (connected to the high side of capacitor 34) of the ON timer 35 begins to build as capacitor 34 charges. Capacitor 34*a* also charges to apply a positive going signal to the A input of timer 35. Concurrently, appropriate base voltage is applied from the high side of capacitor 34 to a start-up transistor 36, which switches to a fully conducting condition to electrically ground the B input and the reset or inhibit input 37*a* of the OFF timer 35 so as to hold such OFF timer in a non-triggered condition. With the continued building of voltage on the charging capacitor 34, the ON timer's B input triggers the timer 35 (positive going signal), wherein the Q output 40 of the timer 35 goes high, or logic 1, while the Q-bar output 41 goes low, or logic 0, such low output 41 driving the transmitter power applying transmitter switch 20 into a conducting condition wherein power is applied from the buss 24 to the transmitter 12 for radiation of a signal by the signal radiating antenna 10, as earlier discussed. It should be noted that prior to the return of the ON timer 35 to its normal condition (Q low/Q-bar high; approximately one second after triggering), the voltage applied to the base of start-up transistors 36 has risen sufficiently to switch off such transistor and release from grounding the B input and the reset or inhibit input 37*a* of the OFF timer 37 so as to prepare such timer 37** for triggering.

It can be seen that the start-up transistor 36 ensures that upon the application of power via power line 32 to the cycling timer circuit, OFF timer 37 will not be triggered prior to the ON timer 35. The ON timer 35 applies power to the transmitter 12 shortly after the application of power to the power line 32 and prior to the first off-time interval provided by the ON-OFF timer 37, as subsequently discussed.

Upon the initial triggering of the ON timer 35, its Q-bar output (low or logic 0) energizes the transmitter power applying transistor switch 20 for a one-second period, whereupon the ON timer returns to its normal state, the ON timer output 40 switching in a negative going direction to its normal low or logic zero state so as to trigger the A input (responsive to negative going signals) of the OFF timer 37 wherein the Q output 38 of the OFF timer 37 goes high (logic 1), while the Q-bar output 39 of the OFF timer 37 goes low (logic 0). While the positive going Q output 38 of the OFF timer 37 has no effect on the A input (negative trigger) of the ON timer 35 to which it is tied via a retrigger line 47, the negative of low going Q-bar output 39 of the OFF timer 37 advantageously holds the reset or inhibit input **35*a* of the ON timer 35 at a logic 0 via an inhibit line 48 so as to prevent false triggering of the ON timer during the 30-second off time period provided by the OFF timer 37**.

At the end of 30 seconds, the OFF timer 37 returns to its normal state (Q low/Q-bar high). It can be seen that the negative going Q output 38 of the OFF timer 37 retriggers, via retrigger line 47, the ON timer via its A input, while simultaneously, the positive going Q-bar output 39 of the OFF timer 37 releases the ON timer from an inhibit condition by removing the low or logic 0 signal from the inhibit line 48. Upon a one-second time-out of the ON timer 35, the OFF timer 37 is retriggered for another 30 seconds of delay in transmitter power applying, during which the Q-bar output 41 of the ON timer 35 is at a high or logic 1 level to bias the transmitter power application transistor switch 20 in an off condition so as to electrically insulate the power buss 24 from the transmitter power input 16.

With the continued application of power to the cycling timer circuit via the timer circuitry power line 32, the timers 35,37, interconnected as earlier explained, function as free-running astable multivibrators so as to cycle the transmitter 12 on for one second of signal radiation and off for approximately 30 seconds (no signal radiation) at a regular interval or duty cycle.

The application of power to the +9-volt DC power buss 24, so as to initiate signal radiation duty cycling of the transmitter 12, will now be discussed. In accordance with the invention, a first switching means, for example an alarm condition switch 54, and a power source, for example a +9-volt battery 52, are provided as inputs to a low battery detect circuit which includes a conventional voltage comparator 56, a timer circuit actuating transistor 57, and a signal pattern transistor switch 58 connected across the signal pattern switching lines 14, as illustrated. The comparator 56 (for example, a Type ICL 8211) functions to continuously compare the voltage of the battery 52 with a reference value established by reference value components in the form of resistors 53. With the voltage of the batteries 52 in excess of the reference value (e.g., +8.0 VDC) established by the resistors 53, the output 51 of the comparator 56 is at a value to bias the transistors 57,58 in an off or non-conducting condition (assuming the alarm switch 54 is in an open or non-conducting condition). With the alarm switch 54 in an open or non-alarm indicating position, the timer circuit actuating transistor 57 remains off and power is not applied to the +9 VDC power buss 24, thus precluding the operation of the cycling timer circuit and transmitter 12, as earlier discussed.

Upon closing of the alarm switch 54 by, for example, smoke detecting means, door or window opening detecting means, or the like, the timer circuit actuating transistor 57 is switched on via base drive line 59 so as to apply power to the buss 24, such power application initiating cycling of the transmitter 12 via the cycling timer circuit which in effect is series-inserted between the transmitter 12 and its power source battery 52. It should be noted that the signal pattern switching transistor 58 remains non-conducting so as to maintain the signal pattern switching lines 14 in an open or non-shorted condition wherein the transmitter 12 radiates via its antenna 10 the radio frequency alarm signal at the first signal pattern noted earlier.

With the switch means 54 in an open of non-alarm indicating condition, the transmitter can also be actuated to indicate a low battery condition wherein decreasing voltage of the battery 52 falls below the predetermined reference value established by reference resistors 53, the output 51 of the comparator 56 changing logic states and switching both transistors 57 and 58 to a conducting condition. Power is applied to the buss 24 and the signal pattern switching lines 14 are effectively shorted via conducting transistor 58 wherein the transmitter intermittently radiates a low battery warning signal at the second radio frequency signal pattern discussed earlier.

The triggered second switching means in the form of the low battery detect circuit can be overridden during conduction of transistors 57 and 58 wherein closing of the switch 54 (indicating a detected alarm condition other than a low battery condition) turns off transistor 58 (via diode 58*a*) in spite of the on signal provided at the comparator output 51 so as to switch the transmitter signal pattern from the low battery indicating condition (lines 14 shorted) to an alarm condition (line 14 open). Such an override feature advantageously permits a higher priority alarm condition (switch 54 closed) to override a lower priority low battery detect condition (transistor switch 58 closed).

In accordance with the invention, and as illustrated by FIG. 1, the transmitter 12, upon being actuated by detection of a low battery condition (closing of transistor switch 58) or an alarm condition (closing of switch 54) will radiate either a low battery detect signal of the second signal pattern (caused by shorting of the signal pattern switching lines 14) or an alarm condition signal of the first signal pattern (lines 14 in an unshorted condition). The transmitter will continue to transmit (one second on; 30 seconds off) as long as switch 54 remains closed, such continuous closure for example indicating a door or window in a left-open condition.

Turning to FIG. 2, there is illustrated a portion of a radio frequency receiver-equipped, central control unit which includes a receiving antenna 60 tuned for reception of the first and second radio frequency signal patterns radiated by the antenna 10 illustrated and discussed with regard to FIG. 1. The received signal radiated by the antenna 10 of the transmitter 12 and received by the antenna 60 is fed to a radio frequency receiver means which includes a low battery detect receiver 62 and an alarm condition receiver 64. Such receivers 62,64 suitable for use in practicing the present invention are manufactured by Multi-Elmac Company of Novi, MI, and carry Model Number 1090. The earlier discussed U.S. Pat. No. 4,140,010 illustrates a receiver of the digital decoding type suitable for use as receivers 62, 64. The receivers 62,64 continuously provide, for example, a DC level output during reception (1 second period) of the radio frequency signal radiated by the antenna 10.

Upon detecting a radio frequency signal of the second signal pattern indicative of a low battery condition at a transmitter location, as discussed earlier with regard to FIG. 1, receiver 62, in a well known manner, switches its output 73 to a level for triggering a low battery detect timer 70 having a time duration of approximately 25 seconds (a period of time substantially greater than the received radio frequency signal of one second). An output 72 of the triggered timer 70 is fed to the input of a warning light actuating clock or timer 76 which functions as an astable multivibrator. The time period of the astable multivibrator type clock 76 is approximately one second to provide a signal for switching on and off an indicator light drive transistor 78, which in turn actuates a low battery warning yellow indicator light 79, flashing at a one-second on, one-second off interval. The flashing of the yellow indicator light 79 (for 25 seconds duration) alerts the user to a low battery condition at one of the transmitter sites, the operator being informed of the need to replace such a low battery to preclude at least partial inoperation of the alarm system. Mechanical devices such as low battery flags can be included at each transmitter site to allow the user to visually determine which particular transmitter has a low battery in need of replacement.

Upon closing of the alarm condition indicating switch 54 of the transmitter (for example, an inadvertently left-open door or window), as illustrated and discussed with respect to FIG. 1, the receiver 64 detects the radiated signal of the first signal pattern and provides, in a conventional manner, an alarm indicating actuation output signal 64*a* (changing DC level) to a false trip detect transistor 65, which in turn trips a timer drive transistor 63, which in turn triggers a retriggerable ON timer 66 having a time duration of, for example, 35 seconds, such 35 second time duration being greater than 30 seconds (the OFF period of the activated transmitter 12—See FIG. 1). Thus, the timer 66 remains in an on condition as long as the transmitter 12 is activated to provide a trigger signal to the timer 66 at least every 30 seconds, with its output 66*a* turning off an indicator light drive transistor 68, which in turn precludes power application to a green false trip indicator light 69. With switch 54 in a closed condition, the green light 69 will not be lit. On the other hand, if the switch 54 is open (normal, non-alarm condition), the output 66*a* of the timer will time out and stay low. The low timer output of 66*a* will switch transistor 68 to a conducting condition, which in turn will energize the indicator 69. The function of the false trip alarm indicator is to warn a user that at least one alarm switch 54 (FIG. 1) is in a closed or actuated condition (no green light), prior to the user's arming of audible or auxiliary indicators to be subsequently discussed. Such a false trip alarm indicator prevents false tripping of the audible or auxiliary alarms by alerting the user to a false alarm condition prior to arming of the alarm system. When such false alarm condition is cleared, the green light indicator will be lit, advising the user that the alarm system can be armed.

Assuming that a low battery condition does not exist, and assuming that the alarm indicating switch means 54 is an open or non-alarm position (indicating, for example, that all doors and windows are closed), the low battery indicator light 79 (yellow) will be off and the false trip indicator light (green) 69 will be on, thus informing the user that the alarm system is fully operational and in a condition for arming.

Figures 3, 4:
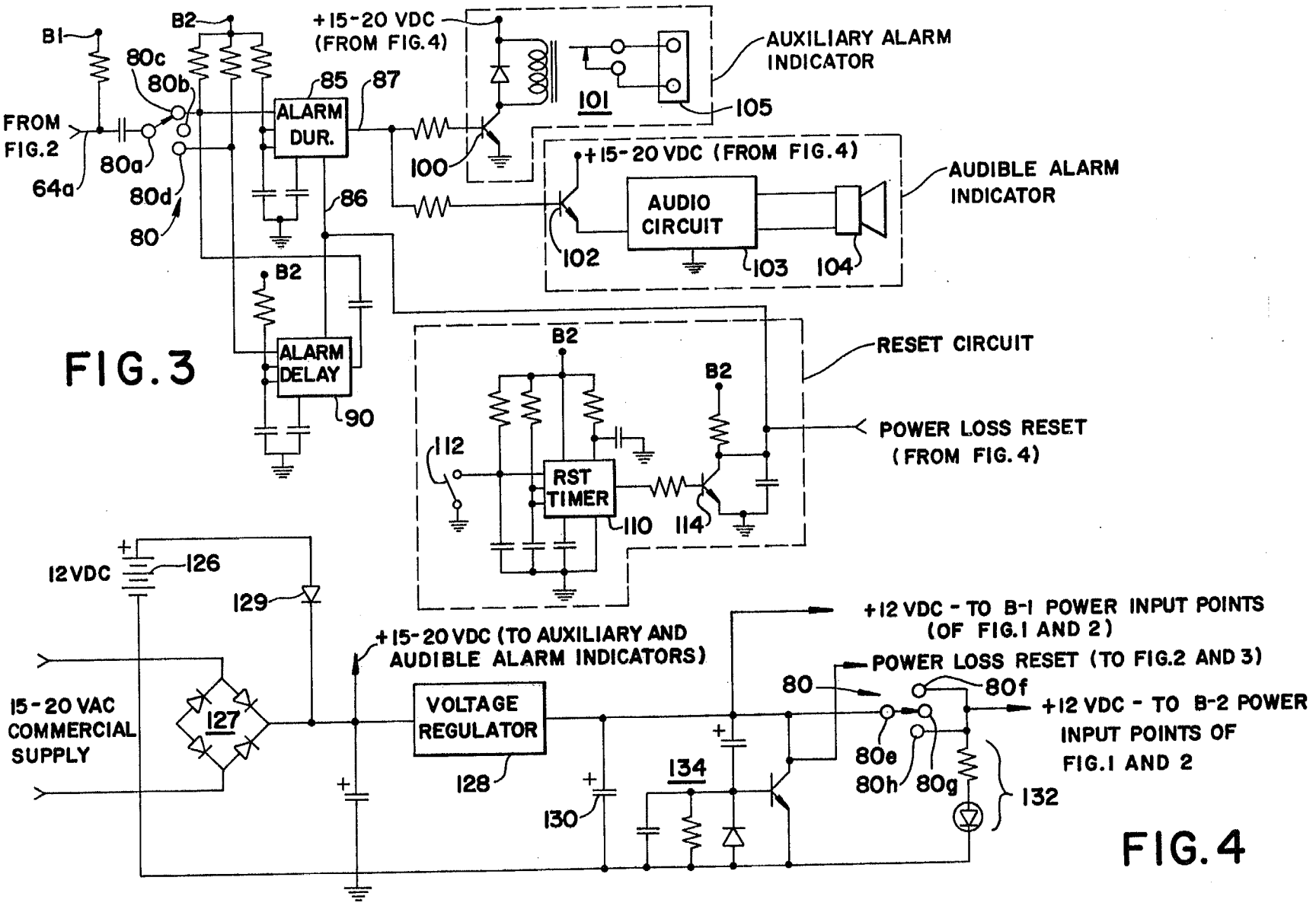
FIG. 3 schematically illustrates another portion of the central control unit in accordance with the invention.
FIG. 4 illustrates a suitable power supply for the central control unit.

With reference to FIG. 3, there is indicated another portion of the central control unit which includes an auxiliary alarm indicator and an audible alarm indicator, along with appropriate timing circuitry (series-inserted between the receiver 64 and the alarm indicators) to permit either an instantaneous or delayed response by the auxiliary and audible indicator alarm indicators upon closing of the switch 54 as discussed with respect to FIG. 1. In accordance with the invention, a double-pole, three-position arming switch 80 (only one pole illustrated in FIG. 3) is provided wherein the alarm actuating signal 64a provided by the receiver 64 is applied to one switched terminal 80a of the arming switch 80. The center position 80b of the arming switch 80 provides an off position. Assuming that the operator does not receive a false trip alarm indication as earlier discussed with regard to FIG. 2, the arming switch 80 is rotated to either an instantaneous position 80c or to an opposed delay position 80d. With the arming switch 80 in its instantaneous position as illustrated in FIG. 3, the actuating signal 64a provided by the receiving 64 (FIG. 2) is applied to an alarm duration timer 85 having a time duration of approximately four minutes. Tripping of the timer 85 by the signal 64a provides an appropriate alarm duration timer output 87, which turns on an auxiliary relay drive transistor 100 and an audible alarm drive transistor 102. The actuation of the transistors 100, 102, respectively energizes a relay 101 and actuates a conventional audio circuit 103 driving an audible siren 104. Actuation of the relay 101 can be used to close contacts of a terminal 105, such contact closure actuating, for example, a telephone dialing mechanism to alert a local police or fire station of an alarm condition. Such telephone dialers are well known in the art.

Actuation of the transistors 100, 102 and their respective relay and audio circuits will be maintained for the four-minute period provided by the timer 85. At the end of such four-minute interval, the timer will turn off transistors 100 and 102 to re-arm the alarm system, assuming that the alarm indicating switch 54 has been returned to an open condition, indicating that an alarm condition has been cleared and is no longer detected at a particular transmitter site. Such instantaneous mode of operation is provided, for example, wherein the user remains within the protected premises.

The delay mode of operation, wherein the switch 80 is moved to its delay position 80d is utilized wherein the operator desires to leave the premises after arming of the alarm, such departure from and return to the premises necessitating tripping of the switch 54 at a transmitter location, for example by opening and closing of a door. Such delay mode is provided in part by initially applying the alarm-actuating signals 64a from receiver 64 to an alarm delay timer 9 having a 30-second time duration. The timer 90 functions to, in effect, delay application of the trip signal 64a from the receiver 64 to the four-minute timer 85, for a period of 30 seconds. Thus, upon re-entry of the premises and tripping of the alarm, the user has approximately 30 seconds to reach the central unit and switch the arming switch 80 to its off position 80b.

With further reference to FIG. 3, a reset circuit is provided, wherein a momentary contact type reset switch 112 actuates a reset timer 110 having a time duration approximtely 30 seconds, the output of the timer 110 driving a reset timer transistor 114 which grounds the reset input 86 of the timers 85 and 90 to hold them in a non-triggerable condition for a 30-second period. The reset switch 112 functions to either turn off the auxiliary and audible alarm indicators prior to the four-minute timeout period of the timer 85 or further to allow the alarm user to arm the system and to depress the reset button to permit 30 seconds of time in which the user can exit the premises.

Turning to FIG. 4, there is illustrated a suitable power supply for the central control unit circuitry illustrated in FIGS. 2 and 3. The power supply includes, for example, a 12-volt DC battery 126, feeding a non-CMOS type LM 7812 voltage regulator 128 via a reverse charged prevent diode 129. The battery 126 functions as an auxiliary power source only when commercial power, applied to the regulator 128 via a full wave diode bridge rectifier 127, is interrupted. Such power supply configurations are well known in the art. In a well known manner, the regulator provides a stable 12-volt DC output across a filter capacitor 130. The power supply includes a conventional light emitting, alarm-on indicator means 132, and further includes a power-on reset circuit 134 which serves, in a conventional manner, to apply a reset signal (electrical ground) to timers 66, 70, 85, and 90, as illustrated in FIGS. 2 and 3, for a short period of time, to preclude their false tripping upon initial application of power subsequent to a non-power condition, wherein both commercial power and battery power were lost.

When the double-pole switch 80 (second half illustrated in FIG. 4) is at the center position 80b (FIG. 3) and 80g (FIG. 4), the alarm is neither in an instantaneous nor delay mode. The alarm indicator 132 is thus not lit. But the false trip indicator 69 (green) and the low battery indicator 79 (yellow) can still be on, due to the fact that their power supply does not go through switch 80 as illustrated in FIG. 4.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wireless alarm system comprising:

a transmitter for radiating a radio frequency signal in response to and during the application of electrical power to the transmitter;

a battery for providing electrical power to the transmitter;

transmitter timer circuitry for intermittently applying to the transmitter electrical power provided by the battery, the timer circuitry being electrically series-inserted between the transmitter and the battery;

switching means responsive to a predetermined alarm condition detected at the general site of the transmitter, activation of the switching means initiating operation of the transmitter timer circuitry, the operating timer circuitry intermittently applying power to the transmitter at regular predetermined intervals while the switching means remains activated, the transmitter intermittently radiating the signal in response to the intermittent application of power to the transmitter; and a radio frequency receiver for reception of the radiated signal, the radio frequency receiver activating at least one alarm indicator in response to reception of the radiated signal, the duration of alarm indicator activation being substantially greater than the duration of the radio frequency signal radiated by the transmitter during the application of power to the transmitter by the timer circuitry.

2. A wireless alarm system according to claim 1, wherein the transmitter timer circuitry includes at least first and second timers, the first timer applying power to the transmitter for a predetermined transmitter on-time duration, the first timer being triggerable by the activation of the switching means, the first timer, upon timing out, activating the second timer, the second timer establishing a predetermined transmitter off-time interval between power applications by the first timer, the second timer upon timing-out retriggering the first timer to initiate power application to the transmitter.

3. A wireless alarm system according to claim 2, wherein the off-time interval is substantially greater than the on-time interval.

4. A wireless alarm system according to claim 2, wherein the timers are electrically interconnected in a free-running astable multivibrator configuration.

5. An alarm system according to claim 2, wherein the first timer applies power to the transmitter immediately after activation of the switching means and prior to the first off-time interval provided by the second timer after activation of the switching means.

6. An alarm system according to claim 5, including a resistor-capacitor circuit for holding the second timer in an inhibit condition until the first timer is triggered by the activation of the switching means, the resistor-capacitor circuit releasing the second timer from an inhibit condition prior to timing out of the first timer in response to its initial triggering by activation of the switching means.

7. A wireless alarm system comprising:

at least one transmitter for intermittently radiating at regular intervals a radio frequency signal in response to the activation of a switching means' response to an alarm condition detected at the general site of the transmitter, the transmitter being powered solely by a battery;

a radio frequency receiver responsive to the radio frequency signal intermittently radiated by the transmitter, the radio frequency receiver providing an alarm actuation signal during the duration the radio frequency signal is being received;

at least one alarm indicator; and receiver switching and timing circuitry electrically series-connected between the radio frequency receiver and the alarm indicator, the receiver switching and timing circuitry initiating energization of the alarm indicator for a predetermined period of time in response to the alarm actuation signal, the duration of energization of the alarm indicator being substantially greater than the duration of the alarm actuation signal provided by the radio frequency receiver.

8. A wireless alarm system according to claim 7, including a delay timer for retarding energization of the alarm indicator for a predetermined period of time after the generation of the alarm actuating signal provided by the radio frequency receiver.

9. A wireless alarm system according to claim 1, including at least two alarm indicators and wherein the switching means includes two separate switches, activation of one of the switches causing the transmitter to radiate the radio frequency signal in a first predetermined pattern, activation of the other of the switches causing the transmitter to radiate the radio frequency signal in a second predetermined pattern distinguishable from the first predetermined pattern, the radio frequency receiver distinguishing between the two predetermined patterns to cause selected energization of the alarm indicators, one of the alarm indicators being energized in response to the radiated signal of the first predetermined pattern, the other of the alarm indicators being energized in response to the radiated signal of the second predetermined pattern.

10. A wireless alarm system according to claim 9, including a low voltage detection circuit monitoring the voltage of the battery, the low voltage detection circuit actuating one of the switches to cause radiation of the signal at one of the predetermined patterns, the receiver activating one of the alarm indicators to alert a user to a low transmitter battery voltage condition.

* * * * *